US005754146A

United States Patent [19]

Knowles et al.

[11] Patent Number: 5,754,146

[45] Date of Patent: May 19, 1998

[54] HELICAL ANTENNA HAVING A PARASITIC ELEMENT AND METHOD OF USING SAME

[75] Inventors: Patrick J. Knowles, Severn; Timothy G. Waterman, Eldersburg, both of Md.

[73] Assignee: Westinghouse Electric Corporation, Pittsburgh, Pa.

[21] Appl. No.: 823,297

[22] Filed: Mar. 21, 1997

Related U.S. Application Data

[63] Continuation of Ser. No. 434,168, Apr. 26, 1995, abandoned.

[51] Int. Cl.[6] ..... H01Q 1/36

[52] U.S. Cl. ..... 343/895; 343/702; 343/815

[58] Field of Search ..... 343/702, 895, 343/815, 817, 818, 833; H01Q 1/36

[56] References Cited

U.S. PATENT DOCUMENTS

| | | | |
|---|---|---|---|
| 2,941,204 | 6/1960 | Bailey | 343/745 |
| 4,008,479 | 2/1977 | Smith | 343/895 |
| 4,012,744 | 3/1977 | Greiser | 343/895 |
| 4,148,030 | 4/1979 | Foldes | 343/895 |
| 4,161,737 | 7/1979 | Albright | 343/749 |
| 4,214,247 | 7/1980 | Richmond | 343/895 |
| 4,868,576 | 9/1989 | Johnson | 343/895 X |
| 5,255,005 | 10/1993 | Terret et al. | 343/895 |
| 5,329,287 | 7/1994 | Strickland | 343/895 X |

OTHER PUBLICATIONS

Patent Abstracts of Japan, vol. 12, No. 518 (E–1434), Sep. 1993, JA, A, 05136623 (Sansei Denki), Jun. 1993.

Patent Abstracts of Japan, vol. 16, No. 22 (E–1156), Jan. 1992, JA, A, 03236612 (Nozomi Aasebe), Oct. 1991.

Adams, "Helix Modes 1 and 2 of Klock" IEEE Transactions on Antennas and Propagation, vol. 16, No. 4, Jul. 1968, New York, USA, pp. 491–493.

Peterron, et al. "Propagation and Radiation Characteristics of the Tape Helix with a Conducting Core and Dielectric Substrate" IEEE Transactions on Antennas and Propagation, vol. 38, No. 4, Apr. 1990, New York, USA, p. 578.

Nakano, et al. "Axial Mode Helical Antennas" IEEE Transactions on Antennas and Propagation, vol. 34, No. 9, Sep. 1986, New York, USA, pp. 1145–1147.

*Primary Examiner*—Donald T. Hajec
*Assistant Examiner*—Tho Phan

[57] ABSTRACT

An efficiently radiating helical antenna includes a conductive helix receiving signals to be radiated at a first end of the conductive helix device for capacitively pulling fields generated by the signals towards a second end of the conductive helix opposite the first end. The device may be a conductive tube inserted into the second end of the conductive helix or a disjointed conductive helix surrounding the conductive helix. This scheme works especially well for a conductive helix having a circumference on the order of one wavelength.

12 Claims, 1 Drawing Sheet

HELICAL ANTENNA HAVING A PARASITIC ELEMENT AND METHOD OF USING SAME

This application is a continuation of application Ser. No. 08/434,168 filed Apr. 26, 1995, now abandoned.

BACKGROUND OF THE INVENTION

1. Field of the Invention

The present invention relates to helical antennas, and, more particularly, to a helical antenna having a parasitic element and a method of using the same. More specifically, the present invention relates to using a parasitic element to lower the impedance at an end of a helical antenna and a method of doing the same.

2. Description of the Related Art

A helical antenna consists of a single conductor or multiple conductors wound into a helical shape. Although a helix can radiate many modes, the axial mode is the most commonly used mode. The axial mode provides maximum radiation along the helix axis, which occurs when the helix's circumference is on the order of one wavelength of the radiation to be radiated. Radiation radiated from a helical antenna with a circumference of about one wavelength also has quite good circular polarization. The helix forming the helical antenna may be cylindrical, elliptical or conical.

In a wire radiator, any wire that is longer than a quarter of a wavelength is capable of radiating all of the power in it before the power reaches the end of the wire. Therefore, in a helical antenna having a circumference of a wavelength, most of the power is gone before it reaches the end of the winding. This ruins the efficiency of the radiation, which is defined as the ability to radiate along the entire length of the antenna with equal amplitude.

As energy is fed into the feed end of a conductor, the conductor acts as an antenna to radiate the energy from the conductor. The amount of radiation per unit length of the conductor decreases exponentially as the energy is conducted away from the feed end. In other words, most of the radiation is emitted from the feed end of the antenna while very little is emitted from the opposite end.

SUMMARY OF THE INVENTION

Accordingly, a primary object of the present invention is to provide a helical antenna which more efficiently radiates along its entire length.

It is a further object to provide a method for more efficiently radiating along the entire length of the helical antenna.

The objects of the present invention are fulfilled by providing a helical antenna having a conductive helix with a first end and a second end. The first end receives signals to be transmitted. The helical antenna also includes a device for capacitively pulling fields generated by the signals towards the second end.

The device for capacitively pulling the field may be a conductor symmetric about the central axis of the conductive helix. This conductor may be a conductive tube inserted into the second end, and the conductor may be supported in the conductive helix by a dielectric surrounding the conductive tube.

Alternatively, the conductor may surround the conductive helix and may be in the form of a disjointed helix. The segments of the disjointed helix may correspond to the turns of the conductive helix. These disjointed segments are further from the first end of the conductive helix than the corresponding turns of the conductive helix.

The objects of the present invention are also fulfilled by providing a method of efficiently radiating along a helical antenna including the steps of delivering signals to a first end of a conductive helix of a helical antenna, capacitively pulling fields formed by the signals towards a second end of the conductive helix, the second end being opposite the first end, and transmitting the signals along the conductive helix. The capacitively pulling step may include inserting a conductor into the second end of the conductive helix or surrounding the conductive helix with a conductor.

These and other objects of the present invention will become more readily apparent from the detailed description given hereinafter. However, it should be understood that the detailed descriptions or specific examples all indicating preferred embodiments of the present invention, were given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
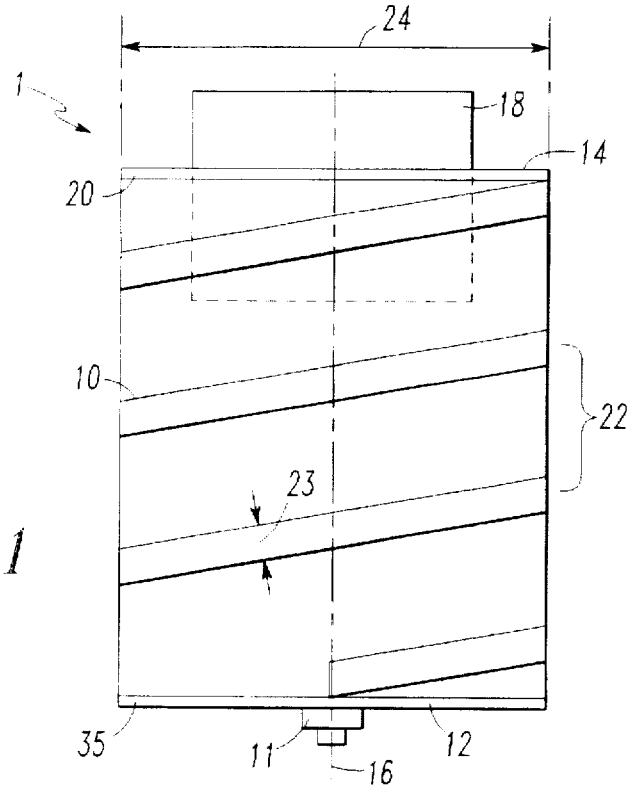
FIG. 1 illustrates a side view of a helical antenna of the present invention.
Figure 2:
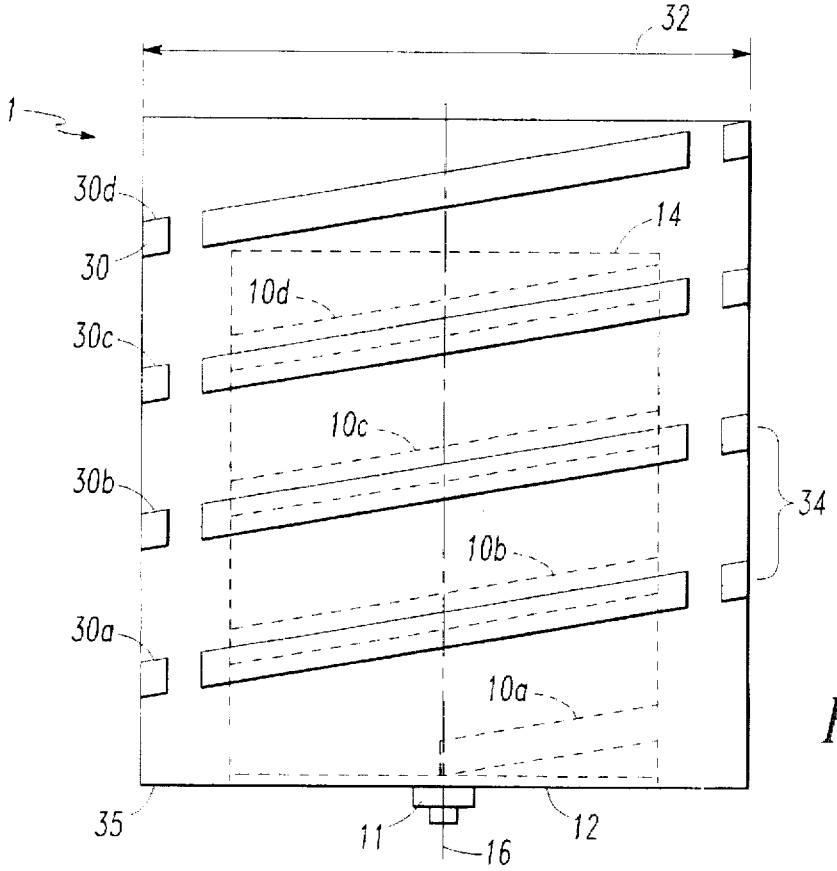
FIG. 2 is a side view of a second embodiment of the helical antenna of the present invention.

FIGS. 1 and 2 illustrate a side view of a helical antenna 1 of the present invention. A conductive helix 10 having a first end 12 and a second end 14 radiates energy emanating from the first end 12 along its length. Energy to be radiated is input to the conductive helix 10 with a conventional input connector 11 into a conductive ground plane 35 at the first end 12. The conductive helix 10 has a central axis 16. The helical antenna 1 has a uniform diameter D indicated at 24. The circumference of the helix is equal to $\pi D$. The conductor itself has a diameter d indicated at 23. A spacing between the turns of the conductive helix 10 is indicated at 22. The axial length of the helix is equal to the product of the number of turns and the spacing S. The length of one turn of the helical conductor 10 is equal to the square root of the sum of the circumference squared and the spacing squared.

A first preferred embodiment of the helical antenna 1 of the present invention is shown in FIG. 1. A parasitic conductor 18 is inserted in the second end 14 of the helical conductor 10. The parasitic conductor 18 may be supported by a dielectric material 20 surrounding the parasitic conductor 18 in the second end 14. Thus, the conductive helix 10 has a lower impedance at the second end 14, and hence, more current is delivered, i.e., capacitively pulled, towards the second end 14. The conductor 18 so inserted in the helical conductor 10 forms a floating capacitor. In order for this capacitance to be distributed uniformly, the parasitic conductor 18 should be symmetric about the central axis of 16 of the conductive helix 10. The parasitic conductor 18 may be in the form of a hollow tube.

A second preferred embodiment of the helical antenna 1 is shown in FIG. 2. Here, the conductive helix 10 is surrounded by a parasitic conductive helix 30. The parasitic conductive helix 30 is advantageously not a continuous helix, but rather is disjointed. If the parasitic conductive helix 30 is continuous, since its circumference is clearly larger than that of the conductive helix 10, it might detune and degrade circularity of the radiated output from the conductive helix 10. Disjointed segments of the parasitic conductive helix 30 are labeled 30*a*, 30*b*, 30*c* and 30*d*. The disjointed segments 30*a*–30*d* follow the pattern or pitch of the conductive helix 10.

Each disjointed segment as shown in the side view of FIG. 2 has a corresponding turn 10*a*, 10*b*, 10*c* or 10*d* in the conductive helix 10. The disjointed segments 30*a*, 30*b*, 30*c* and 30*d* are separated from their corresponding conductive helix portions 10*a*, 10*b*, 10*c* or 10*d* by an interhelix spacing 34. The interhelix spacing 34 is the square root of the sum of the squares of the vertical and horizontal distances between corresponding portions of the conductive helix 10 and the parasitic helix 30. The disjointed segments of the parasitic helix 30 are located above, i.e., further away from, the first end 12 than their corresponding portions 10*a*, 10*b*, 10*c* and 10*d* of the conductive helix 10. Thus, the field along the conductive helix 10 is capacitively pulled away from the first end 12 as the parasitic conductive helix 30 redistributes the currents of the conductive helix 10.

While the embodiment shown in FIG. 2 does require more space than the embodiment shown in FIG. 1, the larger diameter parasitic helix increases the aperture of the helical antenna 1.

The embodiments disclosed herein are most effective for antennas having a circumference of about one wavelength of the signal to be radiated. For such antennas, there can be as much as a 2 decibel improvement in peak gain. Advantageously, the floating capacitor shown in FIG. 1 is inserted into the conductive helix 10 up from the ground plane 35 by a distance of about a half of a wavelength up from the ground plane 35 of the signal to be radiated and has a diameter of roughly 70% that of the conductive helix. As an example, conductive helix 10 may have a diameter of 2.7" (6.86 cm), a height of 3.5" (8.89 cm), a conductor diameter of 0.25" (0.64 cm), a spacing of 1" (2.54 cm) and 3.25 turns. Advantageously, the interhelix distance 34 in FIG. 2 is an eighth of a wavelength of the signal to be radiated and the conductive helix 10 has a diameter and height roughly 70% that of the parasitic conductive helix 30.

The capacitor shown in either FIG. 1 or FIG. 2 may be formed using any conductor and dielectric. The exact parameters to be used are determined empirically for each conductive helix seeking to optimize gain and circularity. Preferably, the parasitic element will provide an increase in capacitance at the second end, such that the exponential current decrease is mitigated or eliminated.

The invention being thus described, it would be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A helical antenna comprising:

a conductive helix having a first end and a second end, said first end having an input for accepting signals to be transmitted, said helix having a circumference equal to approximately one wavelength of the signals to be transmitted, for producing axial mode radiation; and a parasitic conductive tube inserted into said second end and capacitively coupled to said helix for capacitively pulling a field generated by said signals input to said conductive helix towards said second end, said parasitic conductive tube extending from said second end into said helix and being spaced in an axial direction from said first end of the conductive helix.

2. The helical antenna as claimed in claim 1, wherein said parasitic conductive tube is symmetric about a central axis of said conductive helix.

3. A helical antenna as claimed in claim 1, wherein said parasitic conductive tube is supported in said conductive helix by a dielectric surrounding said parasitic conductive tube.

4. The helical antenna as claimed in claim 1, said helical antenna further comprising a conductive ground plane at said first end and wherein said parasitic conductive tube is spaced in said axial direction from said conductive ground plane by a distance of half of a wavelength of said signals.

5. A helical antenna comprising:

a conductive helix having a first end and a second end, said first end having an input for accepting signals to be transmitted, said helix having a circumference equal to approximately one wavelength of the signals to be transmitted, for producing axial mode radiation; and a parasitic conductor disposed around a central axis of said conductive helix and surrounding said conductive helix and capacitively coupled to said helix, for capacitively pulling a field generated by said signals input to said conductive helix towards said second end.

6. The helical antenna as claimed in claim 5, wherein said parasitic conductor comprises a disjointed helix.

7. The helical antenna as claimed in claim 6, wherein said disjointed helix comprises disjointed segments which follow the turn of said conductive helix.

8. The helical antenna as claimed in claim 7, wherein each turn of said conductive helix has a corresponding segment in said disjointed helix located further from said first end than a corresponding turn.

9. The helical antenna as claimed in claim 8, wherein each turn and said corresponding segment are separated by a distance of approximately an eighth of a wavelength of said signals.

10. A method of efficiently radiating along a helical antenna comprising the steps of:

delivering signals to a first end of a conductive helix of said helical antenna, said helix having a circumference equal to approximately one wavelength of the signals, for producing axial mode radiation;

inserting a parasitic conductor into a second end of said conductive helix, said parasitic conductor extending from said second end into said helix, and being spaced in an axial direction from said first end of said helix, to capacitively couple the parasitic conductor to the helix and to capacitively pull a field generated by said signals towards said second end of said conductive helix, said second end being opposite said first end; and transmitting said signals along said conductive helix.

11. The method as claimed in claim 10, wherein said capacitively pulling step further comprises mounting said parasitic conductor in said second end using a dielectric surrounding said parasitic conductor.

12. A method of efficiently radiating along a helical antenna comprising the steps of:

delivering signals to a first end of a conductive helix of said helical antenna, said helix having a circumference equal to approximately one wavelength of the signals, for producing axial mode radiation;

surrounding said conductive helix with a parasitic disjointed helical conductor to capacitively pull a field generated by said signals towards a second end of said conductive helix, said second end being opposite said first end; and transmitting said signals along said conductive helix.

* * * * *